US007128963B2

(12) United States Patent
Benitsch

(10) Patent No.: US 7,128,963 B2
(45) Date of Patent: Oct. 31, 2006

(54) CERAMIC COMPOSITE BODY, METHOD FOR FABRICATING CERAMIC COMPOSITE BODIES, AND ARMOR USING CERAMIC COMPOSITE BODIES

(75) Inventor: Bodo Benitsch, Buttenwiesen (DE)

(73) Assignee: SGL Carbon AG, Wiesbaden (DE)

( * ) Notice: Subject to any disclaimer, the term of this patent is extended or adjusted under 35 U.S.C. 154(b) by 71 days.

(21) Appl. No.: 10/617,640

(22) Filed: Jul. 10, 2003

(65) Prior Publication Data

US 2004/0197542 A1 Oct. 7, 2004

(30) Foreign Application Priority Data

Jul. 10, 2002 (DE) ..... 102 31 278

(51) Int. Cl.
*B32B 9/00* (2006.01)

(52) U.S. Cl. ..... 428/212; 442/135; 427/190; 428/304.1; 428/306.6; 428/307.3; 428/307.7; 428/312.2; 428/312.6; 428/316.6; 428/318.4; 428/319.1; 428/446; 428/698; 428/699

(58) Field of Classification Search ..... 428/212, 428/446, 698, 699, 304.1, 306.6, 307.3, 307.7, 428/312.2, 312.6, 316.6, 318.4, 319.1, 0.7, 428/6; 442/133; 427/190
See application file for complete search history.

(56) References Cited

U.S. PATENT DOCUMENTS 3,954,483 A * 5/1976 Prochazka ..... 501/92
5,114,772 A 5/1992 Vives et al.
5,114,886 A * 5/1992 Tsukada ..... 501/88
5,432,253 A 7/1995 Singh
5,580,834 A * 12/1996 Pfaff ..... 428/446
6,042,935 A * 3/2000 Krenkel et al. ..... 428/307.7
6,358,565 B1 * 3/2002 Krenkel et al. ..... 427/374.4
6,472,058 B1 * 10/2002 Hanzawa et al. ..... 428/293.4
2001/0051258 A1 12/2001 Hanzawa et al.
2002/0028294 A1 3/2002 Krenkel et al.

FOREIGN PATENT DOCUMENTS

| | | |
|---|---|---|
| DE | 196 42 506 C1 | 10/1997 |
| DE | 199 47 731 A1 | 4/2001 |
| EP | 0 287 918 A1 | 10/1988 |
| EP | 0 376 794 A1 | 7/1990 |
| WO | 95/23122 | 8/1995 |

* cited by examiner

*Primary Examiner*—Archene Turner
(74) *Attorney, Agent, or Firm*—Laurence A. Greenberg; Werner H. Stemer; Ralph E. Locher

(57) ABSTRACT

A ceramic composite body includes at least two layers: material layer A and material layer B. Material layer A contains phases of a metal and the carbide of this metal. Material layer B contains silicon carbide that has been loosely bound by sintering. A method for fabricating the composite body is included and a protective armor against projectiles.

22 Claims, 1 Drawing Sheet

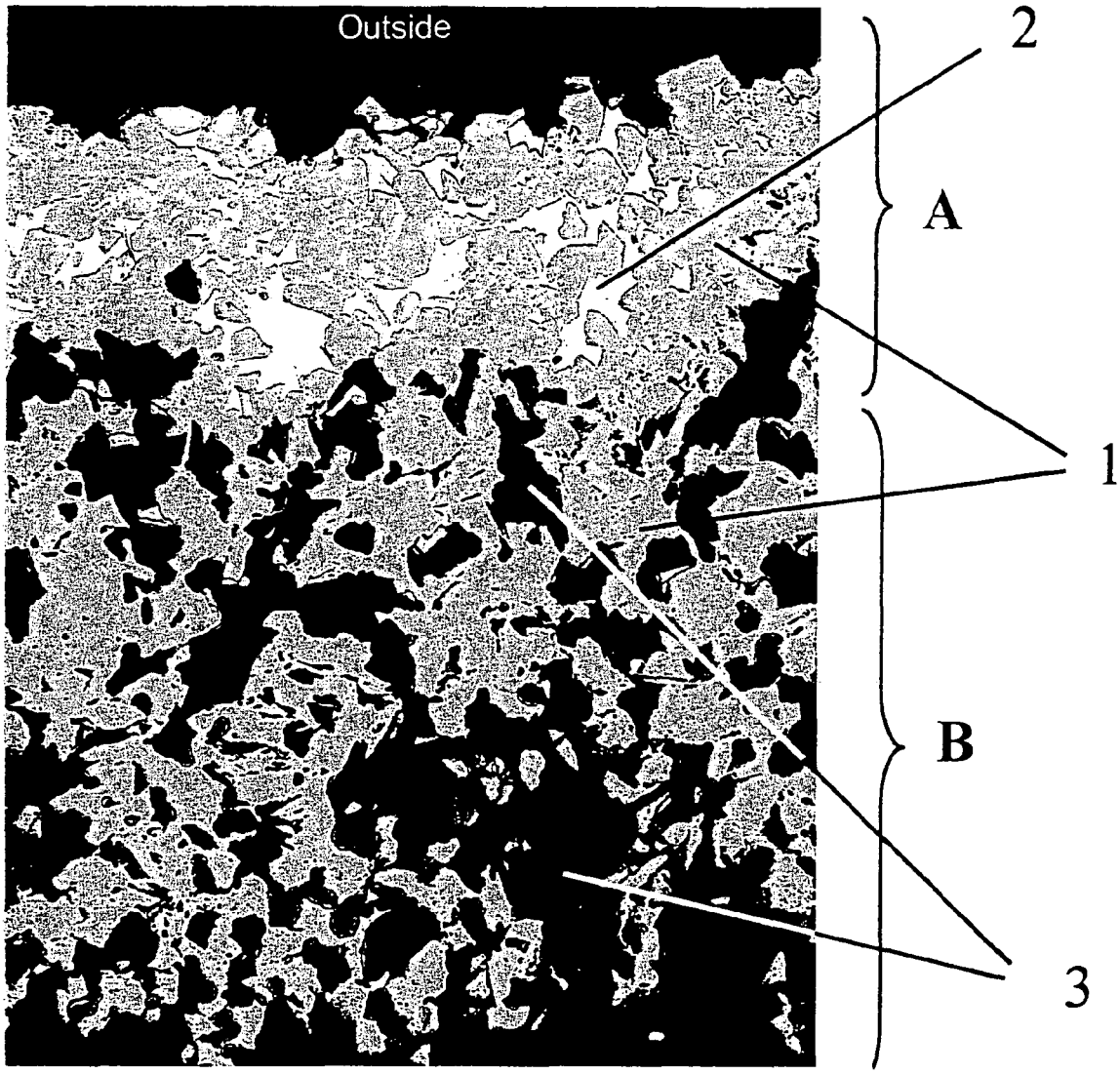
Outside
2
A
1
B
3

CERAMIC COMPOSITE BODY, METHOD FOR FABRICATING CERAMIC COMPOSITE BODIES, AND ARMOR USING CERAMIC COMPOSITE BODIES

BACKGROUND OF THE INVENTION

Field of the Invention

The invention relates to ceramic composite bodies including at least two layers, particularly for armor in civilian and military applications, and methods for fabricating ceramic composite bodies. In particular, the invention relates to bodies including a multilayer composite material containing primarily silicon carbide (SiC) with an exterior layer containing substantially SiC that is bound in a matrix of free silicon (Si) and an interior layer containing loosely bound SiC ceramic powder; and to a method for producing and utilizing these composite bodies.

For protective armors that protect against the ballistic effect of projectiles, different requirements must be satisfied with respect to projectile refraction, multi-hit capability, component geometry, or component weight, depending on the field of use.

In the civilian domain, utilization is centered on personal security, armored limousines, and bulletproof vests. The standards with respect to projectile refraction are not so high, because heavy weapons of middle or large caliber are rarely used in this area. The standards with respect to the weight and geometry of the components, among other things, are high. Parts with complex shapes are needed, coupled with the demand for an optimally small component thickness or build-in depth and low weight. The distance from the threat is usually very short, even as little as a few meters. In case of a multi-hit, which is common, the hits are close to one another. Therefore, the highest standards apply to the multi-hit capability of the armor.

In the military domain, a threat from high-velocity and large-caliber projectiles and explosive projectiles is assumed. Although the standards for component thickness and build-in depth are lower than in the civilian domain, a low specific weight of the armor material is critical here as well, because the armor component must generally be constructed very thick in accordance with the extremely high standards for energy absorption.

The long distances to the targets generally result in large intervals between hits. The standards for multi-hit capability are therefore lower in this case.

For armor in the military domain, flat plates are commonly utilized today as additional armor for land and water vehicles as well as helicopters, containers, receptacles, dugouts and fortifications.

Armor from one or more steel plates is usually treated such that at least the side facing the threat becomes extremely hard and thus able to refract projectiles. The side that is averted from the threat is built more ductile or tougher in order to absorb the energy of the projectile by a deformation of material. This is also the typical construction of armor plates that consist of other materials.

Compared to metals, the advantage of ceramic materials is their greater hardness and lower specific weight. Because monolithic ceramic exhibits a typical brittle fracture when shot, ceramic plates (monolithic ceramic) form a multitude of coarse to fine splinters when they burst. Because of the splintering process that occurs with a shot, it does not make sense to utilize ceramic plates without additional backing (supporting material and splinter trap) on the side that is averted from the entry point of the projectile. The respective ceramic plate is generally totally destroyed by the projectile. A multi-hit thus cannot be sustained.

Therefore, armor that is made of ceramic materials formed as two layers. The front plate, which consists of optimally monolithic ceramic, is responsible for deforming the residual projectile and potentially refracting the hard core. A deformable reinforcement which is attached to the back of the ceramic plate, the backing, is responsible for trapping or absorbing the projectile, fragments, and ceramic splinters and stabilizing the remaining ceramic plate. Accordingly, it is referred to hereinafter as an absorber layer. The backing generally includes high-expansion tear-resistant fabrics (aramide fiber fabrics, HDPE fabrics, etc.), metal or plastics.

Modern material configurations lead to fiber-reinforced composite materials including regions of monolithic ceramic (projectile refractors) and fiber-reinforced ceramic (absorption layer), for instance as described in European Patent Application No. EP 0 376 794 A1, which corresponds to U.S. Pat. No. 5,114,772. The disadvantages of these configurations are the high price and the low availability of suitable fibers for fiber-reinforced ceramics. only relatively expensive carbon fibers are technically significant for the customary sintering technique for manufacturing fiber-reinforced ceramics.

Another approach for achieving the projectile-absorbing and splinter-absorbing effect by using ceramic material is described in European Patent Application No. EP 0 287 918 A1. In one of the cited variants, a multilayer armor plate is described, which consists of a conventional ceramic plate as a front plate and, behind that, an absorber plate formed from what is known as chemically bonded ceramic. The chemically bonded ceramic includes hard fillers such as fibers or ceramic powder and a binding phase (or matrix) including cements that have been modified with organic or inorganic polymers and that harden at low temperatures. The hard fillers lead to blunting, deflection, and fragmentation of the projectile.

The fabrication of multilayer armor plates with a complex geometry and a stable chemical bond between the two material layers according to this method is very expensive.

SUMMARY OF THE INVENTION

It is accordingly an object of the invention to provide a ceramic composite body, a method for fabricating ceramic composite bodies, and armor using ceramic composite bodies that overcome the hereinafore-mentioned disadvantages of the heretofore-known devices of this general type and that make available a ceramic composite body having a projectile-refracting front layer and, permanently joined thereto, an absorber layer. The ceramic composite body is made available by using a cost-effective fabrication method that also allows complex component geometries.

With the foregoing and other objects in view, there is provided, in accordance with the invention, a composite body including at least two layers. The composite body is distinguished by an exterior shot-refracting ceramic layer (front plate) substantially made from a carbide and a carbide-forming metal, preferably SiC and Si (material layer A), and an interior layer (material layer B) that is permanently connected thereto and contains weakly or loosely bound ceramic powder made of SiC.

With the objects of the invention in view, there is also provided a method for fabricating such a composite body. According to the method, the multilayer composite material is produced by the fluid infiltration of a porous base body formed of ceramic particles and carbon material by a carbide-forming metal, particularly silicon metal. The infiltrating step forms both the exterior ceramic layer of carbide and carbide-forming metal, preferably SiC and Si (material A) and the interior layer of weakly or loosely bound ceramic powder substantially consisting of SiC (material B). The two layers are permanently chemically bonded to one another, in a single common step on the basis of the liquid metal infiltration.

The invention is based on the recognition that powder or particulate ceramic, like sand fill, exhibits a highly advantageous absorption behavior relative to ballistic effects, provided that the powder material is mechanically stabilized, that is to say, held together. This cohesion is inventively achieved by the permanently chemically bonded ceramic layer (material A) and the sintering of the ceramic blend of the green body in the region of material B that occurs during the metal melt infiltration.

The inventive composite body thus includes at least two layers. One exterior material layer A contains phases of a carbide-forming metal and the carbide of this metal, preferably reaction-bonded silicon carbide (SiC) and silicon (also referenced SiSiC). And, behind that layer, a material layer B contains loosely bound SiC ceramic powder or particles —as well as additional layers disposed behind these layers, particularly layers of material A or fiber backing. These additional layers further enhance the energy-absorbing effect of the armor.

What is meant by loosely bound ceramic powder or particles is, specifically, material whose stability is at least 20% below that of the material of layer A.

With the preferred method of liquid-metal infiltration with a silicon melt, a ceramic with a good fracture toughness or damage tolerance in addition to very high hardness is formed in the material layer A by the reaction of the carbide-forming metal with carbon. The brittle fracturing behavior of the ceramic, which is harmful with respect to multi-hits, is thus advantageously suppressed. An alloy containing at least 50% silicon by mass, particularly technical silicon or pure silicon, is preferably utilized as the infiltration metal. In the infiltration with a silicon alloy of the metals Fe, Cr, or Ni, silicon carbide preferably forms from the carbon contained in the precursor of material layer A. In infiltration with a titanium silicon alloy, titanium carbide as well as silicon carbide preferably form from the carbon.

The silicon carbide and nitride particles contained in material layer B are sintered together at points of contact at the temperature of infiltration with the liquid metal, whereby a loose structure with pores emerges. The non-volatile pyrolysis products of the organic binder of the raw material mixture also contribute to the stability of material layer B.

Material layer A preferably contains at least 70% SiC particles by mass embedded in a matrix of free silicon. The proportion of SiC is preferably greater than 75%, and particularly above 85%. The proportion of free silicon, which also includes silicon mix phases with other metallic elements, is above 2.8%. Preferably, the proportion of free silicon is in the range between 3 and 21% and particularly between 3and 15%. Material layer A is constructed such that an optimally high hardness is achieved, which can be accomplished with an optimally high density, ideally the theoretical density. The porosity (proportion of pores by volume) of material layer A is preferably under 20%, or the density is at least 2.1 g/cm$^3$, and particularly the porosity is preferably below 10%, or the density is above 2.2 g/cm$^3$. Material A typically includes carbon that is still free and potentially also ceramic additives in proportions of approx. 0.5 to 15% by mass. Hard ceramics on a nitride base are preferably added as ceramic additives. These include the nitrides of Si, Ti, Zr, B, and Al.

The average particle size of the SiC that can be utilized for both material layers A and B is typically in the range between 20 and 750 m. Because a homogenous green body (pre-body of the metal infiltration) is generally initially produced from the ceramic powders, depending on the method, the particle sizes in the material layers A and B differ only insignificantly. But it is also possible to provide different particle sizes for the layers, whereby the material layer A then preferably contains finer material than material layer B. The average particle size in layer A is then preferably under. 50 m, and the average particle size in layer B is over 50 m.

The material layer B is preferably constructed primarily from SiC particles also. The proportion of SiC particles by mass is preferably over 70% and particularly preferably over 90%. The content of ceramic additives is in comparable proportions to the content in layer A. The material layer B preferably contains at least one of the nitrides of the elements Si, Ti, Zr, B, and Al in proportions between 0.05% and 15% by mass. Unlike material A, the ceramic in material layer B—that is to say, its ceramic particles—is not reaction-bonded by silicon; there is almost no matrix of silicon or a silicon alloy present. The proportion of free silicon or silicon/metal phases is typically under 5% by mass, preferably under 2.5%, and particularly preferably under 1%.

The ceramic particles in the material layer B are only weakly bound, in part by way of carbon binding phases, in part directly by way of sintering bridges. Material layer B thus has a relatively high porosity, which is typically between 5% and 35% and preferably in the range between 12% and 27%.

The density of material layer B is generally under 2.55 g/cm$^3$, preferably under 2.05 g/cm$^3$ and particularly preferably under 1.96 g/cm$^3$. The porosity is typically at least 7% higher in material layer B than in material layer A.

The loose bond between the ceramic particles is critical to the inventive effect of material layer B. Among other things, it prevents the tear from spreading through remote regions of a contiguous workpiece part as typically happens with a brittle fracture, although the hardness of the ceramic material is nevertheless exploited. This effect is also achieved when the pores in this layer are filled by a material that is substantially softer than the ceramic.

In another advantageous development of the invention, the intermediate spaces between the ceramic particles in the material layer B are therefore filled with a soft material. A plastic or metal is typically used as the soft material, whereby the metal has a hardness of 5 at most on Mohs' scale. In particular, thermoplastic polymers, resins, glues, elastomers, or aluminum are suitable. At least half the space formed between the ceramic particles is preferably filled with the soft material.

The application of the inventive composite body relates to the field of protective armors, particularly to an anti-ballistic effect. Based on the good thermal characteristics, particularly the high melting point or decomposition point of SiC, the composite material is also a highly suitable armor material for constructing vaults and secure buildings.

Components formed from the inventive composite bodies are usually configured so that the overall thickness of material layers A and B is between 6 and 300 mm. Additional layers, particularly from material A or fiber backing, can be disposed behind the layer of material B. The layer thickness of material A is typically over 1 mm and over 3 mm for armor plating. The thickness ratio of the material layers A and B is typically less than 1:50, preferably less than 1:10, including only the front layer facing the shot side, which consists of material A, as layer A, and the subsequent layer, which consists of material B, as layer B.

Material layer A merges into material layer B, whereby the transition is generally recognizable by a substantial decrease in the silicon content of the matrix.

Other features that are considered as characteristic for the invention are set forth in the appended claims.

Although the invention is illustrated and described herein as embodied in a ceramic composite body, a method for fabricating ceramic composite bodies, and armor using ceramic composite bodies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE is a microscopic abrasion projection of the boundary surface between the material layers A and B of a composite body according to the invention.

DESCRIPTION OF THE PREFERRED EMBODIMENTS

Referring now to the single FIGURE of the drawing, it is seen that gray regions 1 are SiC particles which are distributed approximately uniformly over the whole section. In the upper half A, which corresponds to the material A, the SiC regions are joined by a continuous white phase 2. This is the silicon matrix. The bottom half B, which corresponds to material B, includes pores instead of the matrix (black regions, 3). The other components of carbon or nitride particles are indistinguishable in this representation.

Based on the ease with which it is possible to fabricate a material B that is surrounded on all sides by material layer A, the layer sequence of a front plate consisting of material A, an absorber zone consisting of the material B, and a backplate (or backing) consisting of material A is particularly preferred for flat components.

The composite bodies are inventively produced by the metal liquid infiltration of porous green bodies containing SiC, carbon, and nitride.

The method includes the following important processing steps:

a) Produce a porous carbonaceous green body containing carbides, nitrides, and carbon material;

b) add a melt of a carbide-forming metal over at least one exterior surface of the green body; and c) carry out a metal infiltration and react at least a portion of the metal melt with carbon into metal carbide, forming the different material layers A and B.

In the fabrication of the porous carbonaceous green body, a blend of the solids containing silicon carbide, nitrides and potentially carbon, an organic binder is produced. This blend is shaped according to the customary techniques of the ceramics industry (pressing, injection molding, slipping, among others), whereby the hardening of the organic binder is responsible for the stability of the resulting body. The hardened body is then carbonized by a temperature treatment in the range between 650 and 1600° C., preferably 1000° C. The organic binder is inventively carbonizable; that is, the binder is not completely volatilized by heating under non-oxidizing conditions, but rather a carbon residue forms. The resulting body, the green body, now consists of the added solids, particularly the ceramic particles, which are held together by a binding phase consisting of pyrolitically generated carbon.

The cohesion of the initial blend is preferably selected so that the proportion of silicon carbide in the porous carbonaceous green body is at least 50% by mass, preferably at least 65%. The proportion of carbon from carbonized binder and added solids is typically over 4% by mass and preferably over 8%; the proportion of nitrides is over 1%, preferably over 3%, and particularly preferably between 3 and 12%. The nitrides are selected from at least one of the nitrides of Ti, Zr, Si, B, and Al.

The carbon material that is added as a solid is selected from the following group: coal, coke, natural graphite, technical graphite, carbonized organic material, carbon fibers, glass carbon, and carbonization products. Natural graphite or synthetic graphite are particularly suitable.

A substantial advantage of the invention is that expensive carbon fibers can be completely or almost completely omitted.

It is also possible according to the invention to produce a multilayer green body from different initial blends. Compounds in which the region corresponding to the later material layer B has a higher nitride content are preferred. The ballistic behavior of the multilayer composite body is favorably influenced by this.

In step b), the adding of a metal melt, a carbide-forming metal is infiltrated into the porous green body. The infiltration is supported by the capillary effect and the chemical reaction between the free carbon of the green body and the carbide-forming metal that takes place during the infiltration. In general, the infiltration is carried out at a reduced pressure or in a vacuum at temperatures of approx. 150° C. above the melting point of the infiltration metal.

Silicon alloys, typically from Si and at least one element out of Ti, Fe, Cr, and Mo are preferred as the infiltration metal, but technically pure Si is particularly preferred.

In the liquid metal infiltration, the infiltration metal and its products of reaction with carbon fill the pores of the green body in the outer region, whereas the inner region remains substantially free of infiltration metal and/or its products of reaction with carbon. The proportion of infiltration metal which is supplied by the infiltration in the interior of the inventive composite material, corresponding to material layer B, is typically under 1% by mass, and the proportion of metal carbide that is formed by the infiltration metal is under 3%.

According to the invention, the chemical composition and porosity of the green body and the supply of infiltration metal are selected so that the green body is only partly infiltrated. The infiltration depth can be purposefully controlled specifically by way of the ratio of carbides, carbon and nitrides.

The nitrides impair the cross-linking of the green body with the molten silicon. In particular, the infiltration depth of the silicon melt is reduced, and the degree of conversion of the green body is controlled.

In step c), at least part of the free carbon is converted with the infiltration metal. The conversion can be controlled by way of the temperature and process duration. In this step the material layers A and B are formed. In layer A, a dense ceramic consisting of reaction-bonded metal carbide is formed, namely SiSiC in the preferred instance of infiltration with liquid silicon. In material layer B, where almost none of the infiltration metal reaches, a sintering reaction between the ceramic particles takes place at the temperature of step c), which leads, among other things, to a mechanical stabilization of the material layer. The stability (ultimate breaking strength) must only be high enough that the material B becomes handlable and does not disintegrate offhand. The actual mechanical stabilization of the material layer B occurs by way of the material layer A that is permanently bonded thereto. The stability of layer B can be increased by adding sintering aids that preferably contain Si compounds or powders to the blend for the green body.

The metal melt is typically supplied by wicks or metal powder fills. The metal infiltration typically occurs substantially over the whole surface, so that the material layer A produces a closed material surface. When plate-type green bodies are used, the resulting component includes the layer sequence of material layers A B A in the direction of the surface normals, the preferred direction of the ballistic threat.

This simple procedure for achieving this preferred layer structure is one of the significant advantages of the inventive method.

The mechanical stability of the material layer B can be improved without the typical inventive characteristics resembling a loose powder fill being lost by additionally filling the pores of the material B with a soft material. This can be accomplished by a melt infiltration with a thermoplastic polymer or a liquid infiltration with a polymer resin. The pores are preferably filled at least 30% with polyolefins or epoxy resins.

In another advantageous development of the invention, the pores are infiltrated with glues that are particularly suitable for gluing a backing. Backing materials made of aramide fibers are particularly suitable for this.

In a particularly advantageous development of the invention, the composite body, particularly the material layer B, is infiltrated with a light alloy, particularly Al.

When the pores are filled with a soft material, the residual porosity of the layer B is preferably under 15%.

Filling the pores of the material layer B with a polymer can be particularly advantageous for gluing on a backing, particularly a backing made of fiber mats or fabrics.

I claim:

1. A ceramic composite body, comprising:

a first layer A containing phases of a metal and a carbide of said metal, said first layer A having a porosity of below 20% by volume; and a second layer B containing particles of silicon carbide bound in part by carbon binding phases and in part directly by sintered bridges, said second layer B containing nitrides of at least one element selected from the group consisting of silicon, titanium, zirconium, boron, and aluminum, said second layer B having a porosity of 5 to 35% by volume;

the ceramic composite body being a single one-piece body, the ceramic composite body containing no fibers.

2. The ceramic composite body according to claim 1, wherein said second layer B has a porosity of from 12 to 27% by volume.

3. The ceramic composite body according to claim 1, wherein:

said first layer A has a density over 2.1 g/ccm; and said second layer B has a density under 2.55 g/ccm.

4. The ceramic composite body according to claim 1, wherein said silicon carbide contains at least 25% silicon by mass.

5. The ceramic composite body according to claim 1, further comprising a third layer A, said second layer B being sandwiched between said first and third layers A.

6. The ceramic composite body according to claim 1, wherein said silicon carbide forms 70% by mass of said layer B.

7. The ceramic composite body according to claim 1, wherein:

said first layer A contains nitrides of at least one element selected from the group consisting of silicon, titanium, zirconium, boron, and aluminum; and said layers A and B have equal proportions of nitrides by mass.

8. The ceramic composite body according to claim 7, wherein said proportion of said nitrides in layers A, and B is from 0.05 to 15% by mass.

9. The ceramic composite body according to claim 1, wherein a proportion of said nitrides in said second layer B is from 0.05 to 15% by mass.

10. The ceramic composite body according to claim 1, wherein said layer A contains at least 70% silicon carbide by mass.

11. The ceramic composite body according to claim 1, wherein at least part of a volume of said layer B not filled by said silicon carbide is filled by a filler with a hardness of at most 5 on Mohls' scale, said filler being selected from the group consisting of a plastic, a synthetic resin, an elastomer, a glue, and a metal.

12. A method for fabricating a ceramic composite body according to claim 1, which comprises:

producing a green body containing powdered silicon carbide and a powdered metal nitride and a carbonizable organic binder in a first step;

carbonizing the green body into a porous carbon body containing carbon by heating in a non-oxidizing atmosphere to a temperature between 650° and 1800° C. in a second step;

infiltrating the carbon body from a side with a metal melt containing silicon in a third step;

selecting the temperature to convert at least a portion of the carbon into carbides with a ligand, the ligand being selected from the group consisting of the metal melt and the silicon; and selecting a quantity of the metal melt and the metal nitride to prevent the ligand from entering an inner region of the body.

13. The method according to claim 12, wherein the metal melt containing the silicon contains at least 25% silicon by mass.

14. The method according to claim 12, which further comprises selecting the metal nitride in the green body from the group consisting of titanium nitride, zirconium nitride, silicon nitride, boron nitride, and aluminum nitride.

15. The method according to claim 12, which further comprises including in the green body carbon in a form selected from the group consisting of coke, natural graphite, synthetic graphite, carbonized organic material, carbon fibers, and glass carbon.

16. The method according to claim 12, which further comprises at least partly filling a porosity remaining in the composite body after the infiltrating step with a filler with a hardness of at most 5 on Mohls' scale, the filler being selected from the group consisting of a plastic, a synthetic resin, an elastomer, a glue, and a metal.

17. An armor, comprising a plate having at least two layers made from the ceramic composite body according to claim 1.

18. The armor according to claim 17, wherein said plate has an overall thickness from 6 to 300 mm.

19. The armor according to claim 17, wherein:

said layer A faces a load direction relative to said layer B; and a thickness ratio of said layer A to said layer B is at most 1:20.

20. The armor according to claim 17, further comprising a further layer A; said layer B being sandwiched between said layers A.

21. The armor according to claim 17, further comprising a layer of fiber material reinforcing a side of said plates averted from a load direction.

22. The armor according to claim 21, wherein said fiber material is a textile.

* * * * *

UNITED STATES PATENT AND TRADEMARK OFFICE

CERTIFICATE OF CORRECTION

PATENT NO. : 7,128,963 B2
APPLICATION NO. : 10/617640
DATED : October 31, 2006
INVENTOR(S) : Bodo Benitsch It is certified that error appears in the above-identified patent and that said Letters Patent is hereby corrected as shown below:

Column 4,

Line 7, "750 m." should read -- 750 μm. --.

Line 15, "50 m" should read -- 50 μm --.

Line 16, "50 m" should read -- 50 μm --.

Signed and Sealed this

Twenty-third Day of January, 2007

JON W. DUDAS
*Director of the United States Patent and Trademark Office*